US009277622B2

(12) United States Patent
Kim

(10) Patent No.: US 9,277,622 B2
(45) Date of Patent: Mar. 1, 2016

(54) EMISSION CONTROL LINE DRIVER

(71) Applicant: Yang-Wan Kim, Yongin (KR)

(72) Inventor: Yang-Wan Kim, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 472 days.

(21) Appl. No.: 13/763,026

(22) Filed: Feb. 8, 2013

(65) Prior Publication Data

US 2014/0111092 A1 Apr. 24, 2014

(30) Foreign Application Priority Data

Oct. 24, 2012 (KR) ..... 10-2012-0118231

(51) Int. Cl.

| | |
|---|---|
| ***G09G 3/30*** | (2006.01) |
| ***H05B 37/02*** | (2006.01) |
| ***G09G 3/32*** | (2006.01) |
| ***G09G 5/18*** | (2006.01) |

(52) U.S. Cl.

CPC ..... *H05B 37/02* (2013.01); *G09G 3/3233* (2013.01); *G09G 3/3266* (2013.01); *G09G 5/18* (2013.01)

(58) Field of Classification Search

CPC ..... H05B 37/02; G09G 3/3233; G09G 3/3266
USPC ..... 345/77, 82; 315/169.1–169.4
See application file for complete search history.

(56) References Cited

U.S. PATENT DOCUMENTS

| | | | | |
|---|---|---|---|---|
| 6,362,798 | B1 | 3/2002 | Kimura et al. | |
| 8,290,115 | B2 * | 10/2012 | Kim | G09G 3/3266 345/204 |
| 8,542,225 | B2 * | 9/2013 | Han | H03K 3/356139 345/208 |
| 2009/0066684 | A1 * | 3/2009 | Lee | 345/211 |
| 2010/0188316 | A1 * | 7/2010 | Jang | 345/76 |
| 2012/0062608 | A1 | 3/2012 | Kim | |
| 2012/0176417 | A1 * | 7/2012 | Jang | G09G 3/3266 345/690 |

FOREIGN PATENT DOCUMENTS

| | | | |
|---|---|---|---|
| KR | 10 2012-0028005 | A | 3/2012 |
| KR | 10 2012-0080008 | A | 7/2012 |

* cited by examiner

*Primary Examiner* — Jason M Crawford
(74) *Attorney, Agent, or Firm* — Lee & Morse, P.C.

(57) ABSTRACT

Each stage of an emission control line driver includes a first transistor connected to a first node, a first power source, and a first output terminal; a second transistor connected to second node, the first output terminal, and a second power source; a third transistor connected to a second input terminal, a first input terminal, and the first node; a fourth transistor connected to the first node, the first power source, and the second node; a first controller connected to the first to third input terminals to supply sampling signal to a second output terminal; and a second controller connected to the second input terminal and a fourth input terminal to control the voltage of the second node. The first controller includes a fifth transistor connected between the first power source and the second output terminal, and to the second controller or the first output terminal via a protection unit.

35 Claims, 6 Drawing Sheets

EMISSION CONTROL LINE DRIVER

CROSS-REFERENCE TO RELATED APPLICATION

This application claims priority under 35 U.S.C. §119 to and the benefit of Korean Patent Application No. 10-2012-0118231, filed on Oct. 24, 2012, in the Korean Intellectual Property Office, the entire content of which is incorporated herein by reference.

BACKGROUND

1. Field of the Invention

Embodiments relate to an emission control line driver, and more particularly, to an emission control line driver capable of preventing a damage of an inner circuit device and securing stability of an output.

2. Description of the Related Art

Recently, various flat panel display devices capable of reducing weight and volume which are disadvantages of a cathode ray tube have been developed. Such flat panel display devices include a liquid crystal display device, a field emission display device, a plasma display panel, an organic light emitting display device, and the like. The organic light emitting display device displays an image using an organic light emitting diode (OLED) that generates light by recombination of electrons and holes. The organic light emitting display device has advantages including a fast response speed and low power consumption. A general organic light emitting display device supplies current corresponding to a data signal using a transistor in each of pixels so as to emit light in the organic light emitting display device.

The organic light emitting display device as described above includes a data driver supplying data signals to data lines, a scan driver sequentially supplying scan signals to scan lines, an emission control line driver supplying the emission control signals to a emission control lines, and pixel unit including a plurality of pixels connected to the data lines, the scan lines and the emission control lines.

The pixels included in the pixel unit are selected when the scan signals are supplied to the corresponding scan lines, thereby receiving the data signals from the data lines. The pixels that receive the data signals generate light with brightness corresponding to the data signal and display a predetermined image. Emission times of the pixels are controlled by the emission control signal supplied from the emission control lines. Generally, the emission control signals are supplied to overlap the scan signals that are supplied to one scan line or two scan lines to set the pixels, to which the data signals are supplied, in a non-emission state.

To this end, the emission control line driver includes stages connected to each of the emission control lines. Each of stages receives a plurality of clock signals and outputs high or low voltage to an output line.

SUMMARY

An emission control line driver according to an embodiment may include a plurality of the stages. Each of the stages includes: a first transistor connected between a first power source and a first output terminal, and turned on or off corresponding to the voltage that applied to a first node; a second transistor connected between the first output terminal and a second power source, and turned on or off corresponding to the voltage that applied to a second node; a third transistor connected between a first input terminal and the first node, and having a gate electrode connected to a second input terminal; a fourth transistor connected between the first power source and the second node, and having a gate electrode connected to the first node; a first controller connected to the first input terminal, the second input terminal, and a third input terminal to supply sampling signal to a second output terminal; a second controller connected to the second input terminal and a fourth input terminal to control the voltage of the second node; and wherein the first controller includes a fifth transistor connected between the first power source and the second output terminal, and having a gate electrode connected to the second controller.

The first controller may further includes: a sixth transistor connected between the second output terminal and the third input terminal, and having a gate electrode connected to the third node; a seventh transistor connected between the first input terminal and the third node, and having a gate electrode connected to the second input terminal; and a capacitor (a third capacitor) connected between the third node and the second output terminal. The second controller may includes: an eighth transistor connected between the second input terminal and the fourth node, and having a gate electrode connected to the first node; a ninth transistor connected between the fourth node and the second power source, and having a gate electrode connected to the second input terminal; a tenth transistor connected between the second node and the fifth node, and having a gate electrode connected to the fourth input terminal; an eleventh transistor connected between the fifth node and the fourth input terminal, and having a gate electrode connected to the fourth node; and a capacitor (a fifth capacitor) connected between the fourth node and the fifth node. Here, the fifth transistor may have a gate electrode connected to the fourth node or the second node. The emission control line driver may further include a first capacitor connected between the third input terminal and the second node. The emission control line driver may further include a second capacitor connected between the first power source and the first node. The emission control line driver may further include a fourth capacitor connected between a gate electrode of the fifth transistor and the first power source. The first input terminal may receive a start signal or a sampling signal of a previous stage, the second input terminal receives a first clock signal, the third input terminal receives a second clock signal, and the fourth input terminal receives a third clock signal. Here, the first clock signal, the second clock signal, and the third clock signal do not overlap each other. In addition, each of the first clock signal and the second clock signal are set in a period of i (i is a natural number) period, the third clock signal is set in a period of i/2 horizontal periods. The third clock signal is supplied after the first clock signal or the second clock signal is supplied in a horizontal period.

The emission control line driver may further include: a twelfth transistor connected between the first input terminal and the third transistor, and turned on when the first control signal is supplied; a thirteenth transistor connected between a fifth input terminal and the first controller, and turned on when a second control signal is supplied. Here, the first control signal and the second control signal do not overlap each other. The fifth input terminal receives a start signal or a sampling signal of a next stage. In addition, the emission control line driver may further include a fourteenth transistor connected between the first node and the second power source, and turned on when a reset signal is supplied. Here, the reset signal is commonly supplied to all of the stages.

An emission control line driver according to another embodiment may include a plurality of the stages. Each of the stages includes: a first transistor connected between a first power source and a first output terminal, and turned on or off corresponding to the voltage that applied to a first node; a second transistor connected between the first output terminal and a second power source, and turned on or off corresponding to the voltage that applied to a second node; a third transistor connected between a first input terminal and the first node, and having a gate electrode connected to a second input terminal; a fourth transistor connected between the first power source and the second node, and having a gate electrode connected to the first node; a first controller connected to the first input terminal, the second input terminal, and a third input terminal to supply sampling signal to a second output terminal; a second controller connected to the second input terminal and a fourth input terminal to control the voltage of the second node; and wherein the first controller includes a fifth transistor connected between the first power source and the second output terminal, and having a gate electrode connected to the first output terminal via a protection unit. Here, the protection unit may include a resistor or a capacitor connected between a gate electrode of the fifth transistor and the first output terminal.

The protection unit may include: a protection transistor connected between a gate electrode of the fifth transistor and the first output terminal, and having a gate electrode connected to the second power source. Here, the protection unit may include at least one of the transistors diode-connected between a gate electrode of the fifth transistor and the first output terminal.

DETAILED DESCRIPTION

Figure 1:
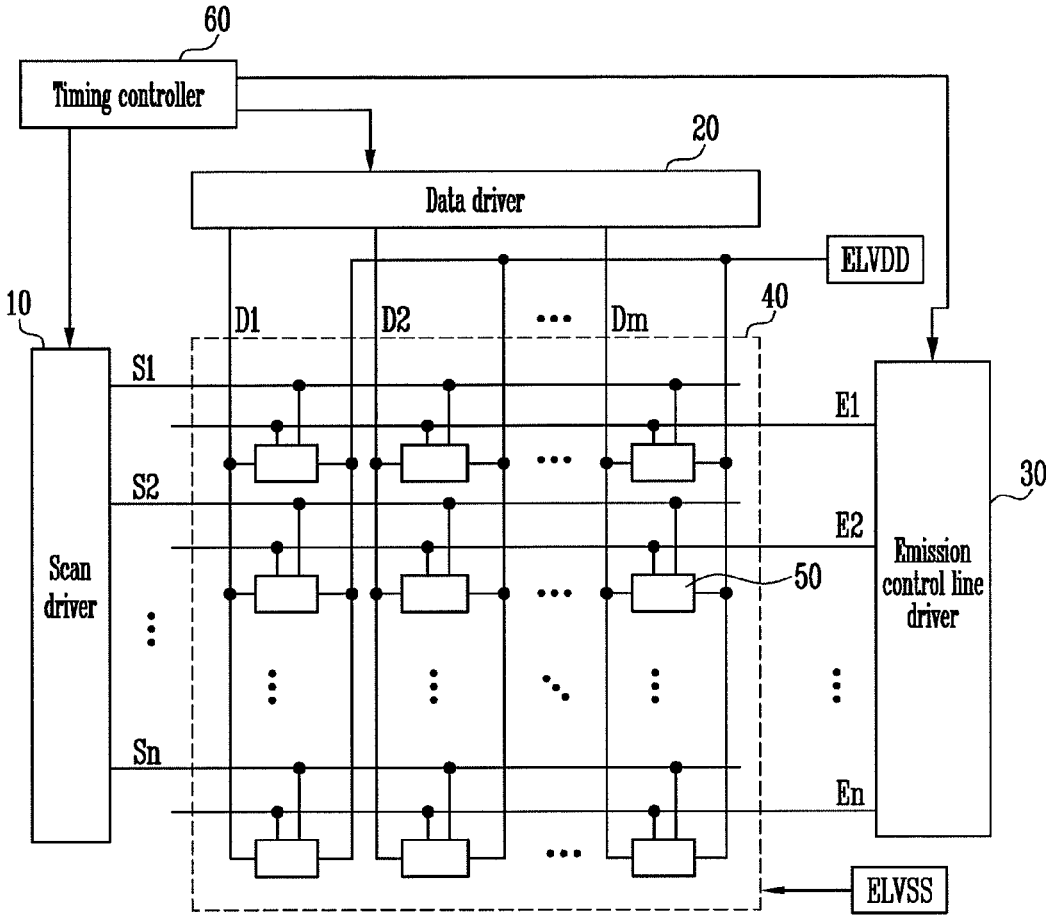
FIG. 1 is a view showing an organic light emitting display device according to an embodiment.

In the following detailed description, only certain exemplary embodiments have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, like reference numerals refer to like elements.

Korean Patent Application No. 10-2012-0118231, filed on Oct. 24, 2012, in the Korean Intellectual Property Office, and entitled: "Emission control line driver" is incorporated by reference herein in its entirety.

Hereinafter, exemplary embodiments that may be easily practiced by those skilled in the art to which the present disclosure pertains will be described in detail with reference to FIGS. 1 to 10.

FIG. 1 is a view showing an organic light emitting display device according to an embodiment. Referring to FIG. 1, the organic light emitting display device according to the exemplary embodiment includes a scan driver 10, a data driver 20, an emission control line driver 30, a pixel unit 40, and a timing controller 60.

The scan driver 10 drives the scan lines S1 to Sn by sequentially supplying the scan signals to the scan lines S1 to Sn When the scan signals are supplied to the scan lines S1 to Sn, the pixels 50 are selected in units of horizontal lines (line by line).

The data driver 20 supplies data signals to the data lines D1 to Dm in synchronization with the scan signals, and drives the data lines D1 to Dm.

The emission control line driver 30 sequentially supplies the emission control signal to the emission control lines E1 to En, and drives the emission control lines E1 to En. The emission control line driver 30 supplies the emission control signals so that the pixels 50 are set in a non-emission state during a period when the voltages corresponding to the data signals are charged. To this end, the emission control signal supplied to an i-th i is a natural number) emission control line Ei overlaps the scan signal supplied to an i-th scan signal Si. A width of the emission control signal may be freely set to correspond to the structure of the pixel 50 and a desired brightness, or the like.

The pixel unit 40 includes the plurality of the pixels 50 positioned on a intersection part of the scan lines S1 to Sn, the data lines D1 to Dm, and the emission control lines E1 to En, and displays the image corresponding to the data signals.

The timing controller 60 controls operations of the drivers 10, 20, and 30 by supplying the driving signals such as clock signals, or the like, to the drivers 10, 20, 30.

Figure 2:
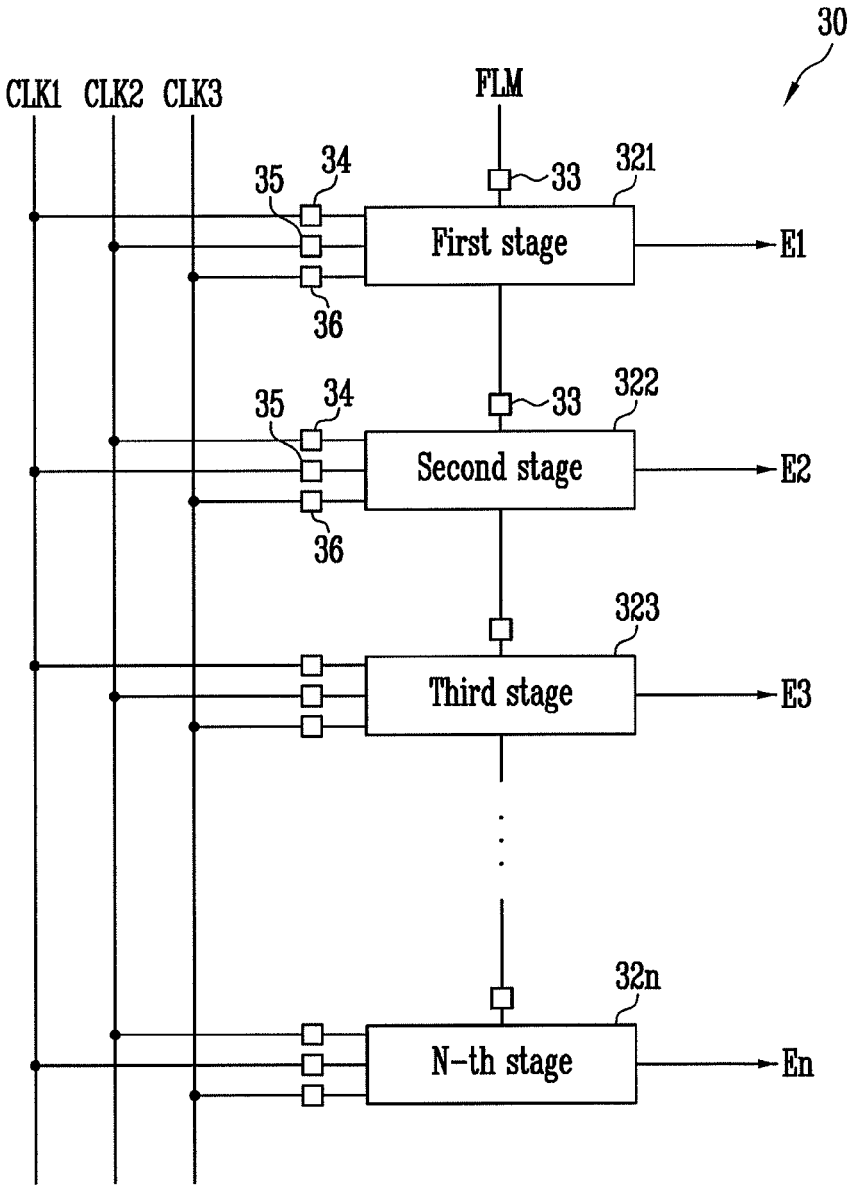
FIG. 2 is a perspective view schematically showing stages of the emission control line driver shown in FIG. 1.

FIG. 2 is a perspective view schematically showing stages of the emission control line driver shown in FIG. 1. Referring to FIG. 2, the emission control line driver 30 according includes n stages 321 to 32*n* in order to supply the emission control signals to n emission control lines E1 to En. Each of the stages 321 to 32*n* is connected to the corresponding emission control lines E1 to En, and is driven by three clock signals CLK1 to CLK3. Each of the stages 321 to 32*n* includes a first input terminal 33, a second input terminal 34, a third input terminal 35, and a fourth input terminal 36.

A start signal FLM or a sampling signal of a previous stage is supplied to the first input terminal 33. The second input terminal 34 included in a k-th (k is an odd number or an even number) stage 32*k* receives the first clock signal CLK1, and the third input terminal 35 receives the second clock signal CLK2. Further, the second input terminal 34 of a k+1-th stage 32+1 receives the second clock signal CLK2, and the third input terminal 35 receives the first clock signal CLK1. The fourth input terminal 36 of each of the stages 321 to 32*n* receives the third clock signal CLK3.

The foregoing stages 321 to 32*n* may be formed of the same circuitry and may generate the emission control signals having a width that is changed to correspond to the start signal FLM.

Figure 3:
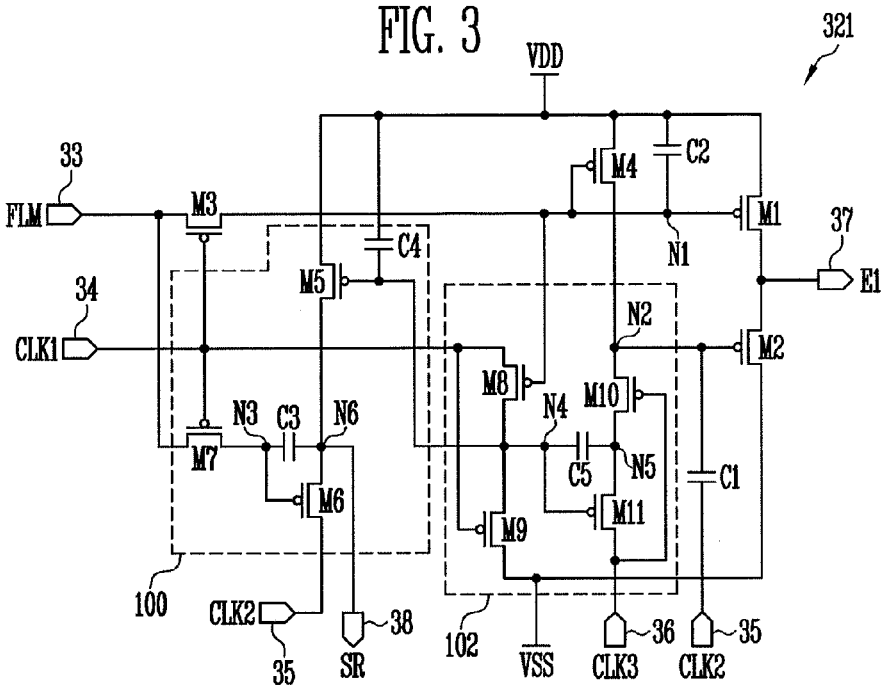
FIG. 3 is a circuit diagram showing a first embodiment of one of the stages shown in FIG. 2.

FIG. 3 is a circuit diagram showing a first embodiment of one of the stages shown in FIG. 2. In FIG. 3, the first stage 321 will be described, for convenience of explanation.

Referring to FIG. 3, the stage 321, according to the first embodiment, includes a first transistor M1, a second transistor M2, a third transistor M3, a fourth transistor M4, a first capacitor C1, a second capacitor C2, a first controller 100, and a second controller 102.

The first transistor M1 is connected between a first power source VDD and a first output terminal 37. A gate electrode of the first transistor M1 is connected to the first node N1. The first transistor M1 controls the voltage of the first output terminal 37 in accordance with a voltage applied to the first node N1. When the first transistor M1 is turned on, a high voltage of the first power source VDD is supplied to the first output terminal 37. Since the first output terminal 37 is connected to the emission control line E1, the high voltage supplied to the first output terminal 37 is used as an emission control signal for preventing emission of the pixel.

The second transistor M2 is connected between the first output terminal 37 and a second power source VSS. A gate electrode of the second transistor M2 is connected to a second node N2. The second transistor M2 controls the voltage of the first output terminal 37 in accordance with a voltage applied to the second node N2. When the second transistor M2 is turned on, a low voltage of the second power source VSS is supplied to the first output terminal 37.

The third transistor M3 is connected between the first input terminal 33 and the first node N1. A gate electrode of the third transistor M3 is connected to the second input terminal 34. The third transistor M3 is turned on or off in accordance with a first clock signal CLK1 supplied to the second input terminal 34. When the third transistor M3 is turned on, the first input terminal 33 and the first node are electrically connected to each other, and, when the start signal FLM (or a previous stage sampling signal) is supplied to the first input terminal 33 in state in which the third transistor M3 is turned on, the first transistor M1 is turned in accordance with the start signal FLM.

The fourth transistor M4 is connected between the first power source VDD and the second node N2. A electrode of the fourth transistor M4 is connected to the first node N1. The fourth transistor M4 is turned on or off in response to the voltage that is applied to the first node N1 in order to control the voltage of the second node N2. That is, when a low voltage is applied to the first node N1, the fourth transistor M4 is turned on, and a high voltage of the first power source VDD is supplied to the second node N2. When the low voltage is applied to the first node N1, the high voltage of the first power source VDD is supplied to the second node N2, so that the first and second transistors M1 and M2 are turned on or off at different times.

The first capacitor C1 is connected between the second node N2 and the third input terminal 35. The first capacitor C1 controls the voltage of the second node N2 in accordance with the second clock signal CLK2 supplied to the third input terminal 35. A detail of operation process of the first capacitor C1 will be described below.

The second capacitor C2 is connected between the first power source VDD and the first node N1. The second capacitor C2 is charged with the voltage corresponding to the turning on or turning off of the first transistor M1.

The first controller 100 supplies the sampling signal SR to the second output terminal 38 in accordance with the first clock signal CLK1 to the second clock signal CLK2 supplied to the second input terminal 34 and the third input terminal 35, respectively. To this end, the first controller 100 includes the fifth to seventh transistors M5 to M7 and the third and fourth capacitors C3 and C4.

The fifth transistor M5 is connected between the first power source VDD and a sixth node N6. A gate electrode of the fifth transistor M5 is connected to the second controller 102. For example, the gate electrode of the fifth transistor M5 may be connected to a fourth node N4 in the second controller 102. The fifth transistor M5 is turned on or off in accordance with a voltage applied to the fourth node N4 in order to control the voltage of a sixth node N6. The sixth node N6 is connected to the second output terminal 38 where the sampling signal SR is output to a next stage.

The sixth transistor M6 is connected between the third output terminal 35 and the sixth node N6. A gate electrode of the sixth transistor M6 is connected to the third node N3. The sixth transistor M6 controls the voltage of the sixth node N6 in accordance with a voltage applied to the third node N3.

The seventh transistor M7 is connected between the first output terminal 33 and the third node N3. A gate electrode of the seventh transistor M7 is connected to the second input terminal 34. The seventh transistor M7 is turned on or off in accordance with the first clock signal CLK1 supplied to the second input terminal 34 in order to control the voltage of the third node N3.

The third capacitor C3 is connected between the third node N3 and the sixth node N6. The third capacitor C3 is charged with a voltage corresponding to the turning on or off voltage of the sixth transistor M6.

The fourth capacitor C4 is connected between the first power source VDD and the fourth node N4. That is, the fourth capacitor C4 is connected between the first power source VDD and the gate electrode of the fifth transistor M5, and charged with the voltage corresponding to the turning on or off of the voltage of the fifth transistor M5.

The second controller 102 controls the voltage of the second node N2 in accordance with the first clock signal CLK1 and the second clock signal CLK2 supplied to the second input terminal 34 and the third input terminal 36, respectively. In a period when the emission control signal is not supplied to the first output terminal 37, the second controller 102 maintains the voltage of the second node N2 as a low voltage. To this end, the second controller 102 includes eighth to eleventh transistors M8 to M11, and the fifth capacitor C5.

The eighth transistor M8 is connected between the second input terminal 34 and the fourth node N4. A gate electrode of the eighth transistor M8 is connected to the first node N1. The eighth transistor M8 is turned on or off in accordance with a voltage applied to the first node N1 in order to control the voltage of the fourth node N4.

The ninth transistor M9 is connected between the fourth node N4 and the second power source VSS. A gate electrode of the ninth transistor M9 is connected to the second input terminal 34. The ninth transistor M9 is turned on or off in accordance with the first clock signal CLK1 supplied to the second input terminal 34 in order to control the voltage of the fourth node N4.

The tenth transistor M10 is connected between the second node N2 and the fifth node N5. A gate electrode of the tenth transistor M10 is connected to the fourth input terminal 36. The tenth transistor M10 is turned on or off in accordance with the third clock signal CLK3 supplied to the fourth input terminal 36 in order to control the voltage of the second node N2.

The eleventh transistor M11 is connected between the fourth input terminal 36 and the fifth node N5. A gate electrode of the eleventh transistor M11 is connected to the fourth node N4. The eleventh transistor M11 is turned on or off in accordance with the voltage applied to the fourth node N4 in order to control the voltage of the fifth node N5.

The fifth capacitor C5 is connected between the fourth node N4 and the fifth node N5. The fifth capacitor C5 is charged with the voltage corresponding to the turning on or off of the eleventh transistor M11.

Figure 4:
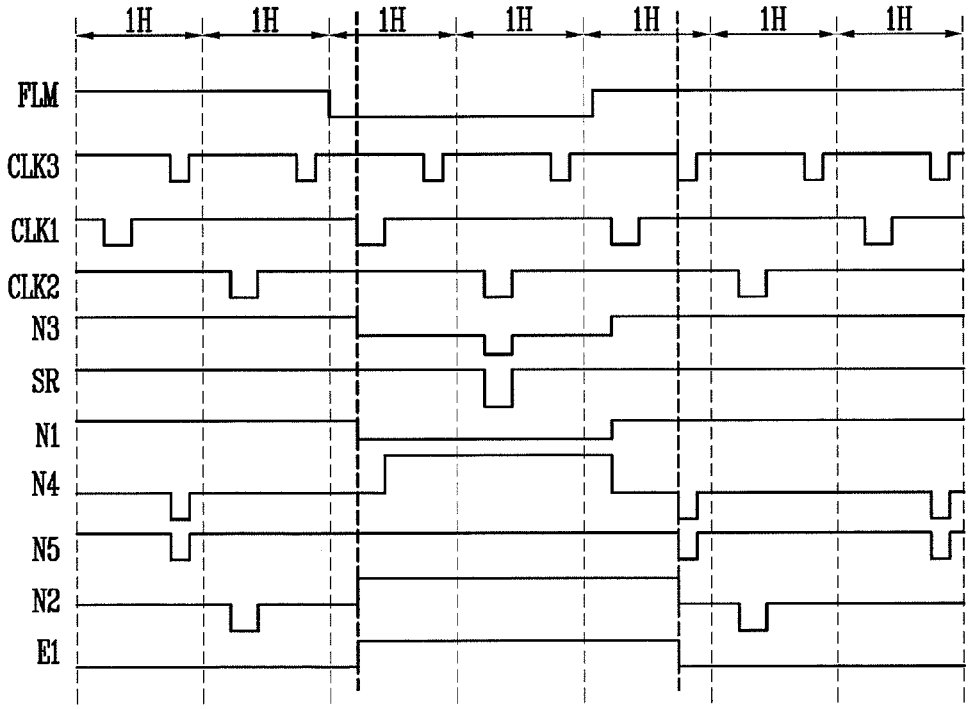
FIG. 4 is a waveform chart showing an operation method of the stage shown in FIG. 3.

FIG. 4 is a waveform chart showing an operation method of the stage shown in FIG. 3. In FIG. 4, the first clock signal CLK1 and the second clock signal CLK2 are supplied in a period of 1H (i is a natural number), and the third clock signal CLK3 is supplied in a period of i/2H. For example, in FIG. 4, the first clock signal CLK1 and the second clock signal CLK2 are set in a period of 2H, and the third clock signal CLK3 is set in a period of 1H. Alternatively, this method may be applied using a clock signal that functions like the third clock signal CLK3 but divided into two clock signals having periods same as that of the first and second clock signals CLK1 and CLK2, with each of the divided signals are supplied to even and odd stages, respectively.

Referring to FIG. 4, the first clock signal CLK1 and the second clock signal CLK2 are supplied in different horizontal periods H, and the third clock signal CLK3 is supplied every horizontal period H so as not to overlap the first clock signal CLK1 and the second clock signal CLK2. In addition, in the horizontal period H, the third clock signal CLK3 is supplied after the first clock signal CLK1 and the second clock signal CLK2 are supplied. That is, during a specific horizontal period, the third clock signal CLK3 is supplied after the first clock signal CLK1 is supplied, and then, during the next horizontal period, the third clock signal CLK3 is supplied after the second clock signal CLK2 is supplied.

As FIG. 4 is related with FIG. 3, the operation process of the stage shown in FIG. 3 will be described in more detail. First, the start signal FLM (a low voltage) is supplied to the first input terminal 33. In addition, after the start signal FLM is supplied, the first clock signal CLK1 is supplied to the second input terminal 34. When the first clock signal CLK1 is supplied, the third transistor M3, the seventh transistor M7, and the ninth transistor M9 are turned on.

When the third transistor M3 is turned on, the start signal FLM of a low voltage is supplied to the first node N1, the first transistor M1, the fourth transistor M4, and the eighth transistor M8 are turned on. When the first transistor M1 is turned on, the second capacitor C2 is charged with the voltage corresponding to the turning on of the first transistor M1.

When the first transistor M1 is turned on, a high voltage of the first power source VDD is supplied to the first output terminal 37. The foregoing high voltage, as an emission control signal (a high voltage) that controls light emitting of the pixels, is supplied to the emission control line E1.

When the fourth transistor M4 is turned on, a voltage of the first power source VDD is supplied to the second node N2. Therefore, the second transistor M2 is turned off, and voltage of the first power source VDD may be stably supplied to the first output terminal 37.

When the eighth transistor M8 is turned on, the second input terminal 34 is connected to the fourth node N4. At this time, since the second input terminal 34 receives the first clock signal CLK1, the fourth node N4 receives the row voltage.

When the seventh transistor M7 is turned on, the start signal FLM is supplied to the third node N3 and the sixth transistor M6 are turned on. When the sixth transistor M6 is turned on, the sixth node N6 and the third input terminal 35 are electrically connected to each other. Here, since the second clock signal CLK2 is not supplied to the third input terminal 35, the sixth node N6 maintains a high voltage so that the sampling signal SR is not supplied to the second output terminal 38. Meanwhile, when the sixth transistor M6 is turned on, the third capacitor C3 is charged with the voltage corresponding to the turning on of the sixth transistor M6.

When the ninth transistor M9 is turned on, a low voltage of the second power source VSS is supplied to the fourth node N4. When a low voltage is applied to the fourth node N4, the fifth and the eleventh transistors M5 and M11 are turned on so that the sixth node N6 and the fifth node N5 maintain the high voltage of the first power source VDD and the third clock signal CLK3, respectively. Meanwhile, when the fifth and eleventh transistors M5 and M11 are turned on, each of the fourth and fifth capacitors C4 and C5 is charged with the voltage corresponding to the turning on of each of the fifth and eleventh transistors M5 and M11, respectively After, when the supply of the first clock signal CLK1 to the second input terminal 34 is stopped, the third transistor M3, the seventh transistor M7, and the ninth transistor M9 are turned off. In addition, since the eighth transistor M8 maintains a turn on state by the voltage of the first node N1, the fourth node N4 and the second input terminal 34 maintain a connected state. Therefore, the voltage of the fourth node N4 is changed into the high voltage and the fifth and eleventh transistors M5 and M11 are turned off. Here, each of the fourth and fifth capacitors C4 and C5 is charged with the voltage corresponding to the turning off of each of the fifth and eleventh transistors M5 and M11, respectively When the third transistor M3 is turned off, the first output terminal 33 and the first node N1 are electrically disconnected. Here, the first node N1 maintains a low voltage by the second capacitor C2. Accordingly, the first transistor M1 maintains a turn on state, and the voltage of the first power source VDD is supplied to the first output terminal 37. Similarly, since the fourth transistor M4 maintains a turn on state by the second capacitor C2, the second transistor M2 stably maintains a turn off state.

When the seventh transistor M7 is turned off, the first input terminal 33 and the third node N3 are electrically disconnected. Here, the sixth transistor M6 maintains a turn on state to correspond to the voltage charged at the third capacitor C3, therefore, the second output terminal 38 maintains a previous high voltage.

When the ninth transistor M9 is turned off, the fourth node N4 and the second power supply VSS are electrically disconnected. Here, as described above, the fourth node N4 maintains a connection to the second input terminal 34, and voltage of the fourth node N4 of the first clock signal CLK1 is changed into a high voltage by the eighth transistor M8 that maintains a turn on state.

Then, when the third clock signal CLK3 is supplied to the fourth input terminal 36, the tenth transistor M10 is turned on such that the second node N2 and the fifth node N5 are electrically connected to each other. Here, since the fourth transistor M4 maintains a turn on state and the eleventh transistor M11 maintains a turn off state, simultaneously, the second node N2 maintains the high voltage of the first power source VDD.

After the third clock signal CLK3 is supplied, the second clock signal CLK2 is supplied to the third input terminal 35 in a next horizontal period. At this time, since the sixth transistor M6 maintains a turn on state, a low voltage of the second clock signal CLK2 is supplied to the sixth node N6. The second clock signal CLK2 supplied to the sixth node N6 as a sampling signal SR is supplied to the next stage via the second output terminal 38. Meanwhile, when the second clock signal CLK2 is supplied to the sixth node N6, the voltage of the third node N3 is reduced by the coupling of the third capacitor C3. Therefore, the sixth transistor M6 stably maintains a turn on state.

Additionally, the second clock signal supplied to the third input terminal 35 is transmitted to the second node N2 by the coupling of the first capacitor C1. However, since the second node N2 receives the voltage of the first power source VDD, the voltage of the first power source VDD is maintained without a change in a voltage.

Then, when the third clock signal CLK3 is supplied to the fourth input terminal 36, the tenth transistor M10 is turned on such that the second node N2 and the fifth node N5 are electrically connected to each other. Here, since the fourth transistor M4 maintains a turn on state and the eleventh transistor M11 maintains a turn off state, simultaneously, the second node N2 maintains the high voltage of the first power source VDD.

After the third clock signal CLK3 is supplied, a supply of the start signal FLM is stopped (that is, the voltage of the start signal FLM is changed into a high voltage) and the first clock signal CLK1 is supplied to the second input terminal 34.

When the first clock signal CLK1 is supplied, the third transistor M3, the seventh transistor M7, and the ninth transistor M9 are turned on.

When the third transistor M3 is turned on, the first input terminal 33 and the first node N1 are electrically connected to each other, and the high voltage of the start signal FLM is supplied to the first node N1. Accordingly, the first, fourth, and eighth transistors M1, M4, and M8 are turned off. When the first transistor M1 is turned off, the first output terminal 37 is set in a floating state. In this case, the first output terminal 37 maintains the high voltage that is an output signal of a previous period.

Since the emission control signal supplied to the emission control line E1 is supplied to the pixels 50, charging is performed by the capacitors of the pixels. Therefore, although the first output terminal 37 is set in a floating state, the output voltage of a previous period is maintained by parasitic capacitors, or the like, of the pixels 50 and the emission control line E.

When the seventh transistor M7 is turned on, the high voltage of the start signal FLM is supplied to the third node N3, therefore, the sixth transistor M6 is turned off. When the sixth transistor M6 is turned off, the sixth node N6 and the third input terminal 35 are electrically disconnected to each other. At this time, the third capacitor C3 is charged with the voltage corresponding to the turning on or off of the sixth transistor M6.

When the ninth transistor M9 is turned on, the low voltage of the second power source VSS is supplied to the fourth node N4, the fifth and eleventh transistors M5 and M11 are turned on.

When the fifth transistor M5 is turned on, the high voltage of the first power source VDD is transmitted to the sixth node N6 so that the high voltage may be stably supplied to the second output terminal 38. At this time, the fourth capacitor C4 is charged with the voltage corresponding to the turning on of the fifth transistor M5.

When the eleventh transistor M11 is turned on, the fifth node N5 and the fourth input terminal 36 are electrically connected to each other. In addition, the fifth capacitor C5 is charged with the voltage corresponding to the turning on of the eleventh transistor M11.

Then, when the third clock signal CLK3 is supplied to the fourth input terminal 36, the tenth transistor M10 is turned on. In addition, in this period, the eleventh transistor M11 maintains a turn on state of a previous period. Accordingly, when the second node N2 and the fourth input terminal 36 are electrically connected to each other, a low voltage of the third clock signal CLK3 is supplied to the second node N2.

When the second node N2 receives a low voltage, the second transistor M2 is turned on so that a low voltage of the second power source VSS output to the first output terminal 37. Therefore, a supply of the emission control signal to the emission control line E1 is stopped.

Meanwhile, according to the first embodiment, the third clock signal CLK3 is set to a lower voltage than that of the second power source VSS so that the second transistor M2 is stably turned on.

Then, the stage 321 outputs a low voltage of the second power source VSS to the first output terminal 37 before the next start signal FLM is supplied.

According to the first embodiment, whenever the second clock signal CLK2 is supplied, the voltage of the second node N2 is reduced by the coupling of the first capacitor C1. Accordingly, the voltage of the second node N2 stably maintains a low voltage so that the voltage of the second power source VSS may be stably output to the first output terminal 37.

Meanwhile, the sampling signal SR is supplied to the next stage in synchronization with the second clock signal CLK2 (in the next stage, the second clock signal CLK2 is supplied to the second input terminal). In this case, the next stage stably outputs the emission control signal using the sampling signal SR.

Additionally, FIG. 4 illustrates that one sampling signal SR is generated corresponding to the start signal FLM, embodiments are not limited thereto. For example, when the start signal FLM overlaps two first clock signal CLK1, the two sampling signal SR is supplied to the next stage. Therefore, according to the first embodiment, a width of the start signal FLM is controlled so that a width of the emission control signal may be freely controlled.

Particularly, according to the first embodiment, the gate electrodes of the transistors M configured an inner circuit of each of the stages 321 may be indirectly connected to an output line, such as emission control line E, or the like, having a large load. For example, the gate electrode of the fifth transistor M5 is not connected to the emission control line E, but connected to the fourth node N4. That is, the emission control line driver 30 according to the first embodiment is implemented as a structure in which a gate electrode of the transistors M in an inner circuit is not directly connected to the emission control line E having a large load, and stably outputs the emission control signal. Therefore, reliability of the emission control line driver 30 is secured by preventing damage to an inner circuit device due to a static electricity, or the like, introduced from the outside.

Figure 5:
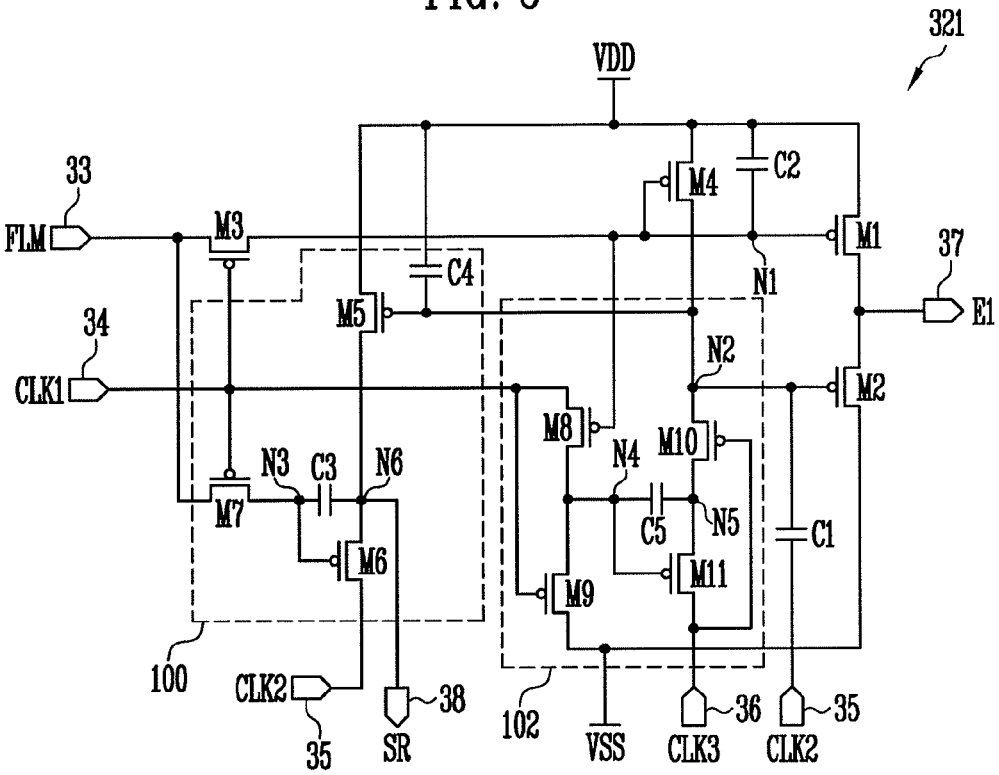
FIG. 5 is a circuit diagram showing a second embodiment of the stages shown in FIG. 2.

FIG. 5 is a circuit diagram showing a second embodiment of the stages shown in FIG. 2. When FIG. 5 is described, detailed description of a part which is similar to or same as FIG. 3 will be omitted.

Referring FIG. 5, the gate electrode of the fifth transistor M5 is connected to the second node N2. Thus, the fifth transistor M5 is turned on or off in accordance with the voltage applied to the second node N2 in order to control the voltage of the sixth node N6. When a voltage of the second node N2 is a low voltage, the fifth transistor M5 is turned on so that the voltage of the first power source VDD is supplied to the sixth node N6.

When a low voltage of the sampling signal SR is supplied to the second output terminal 38 in accordance with the second clock signal CLK2, the second node N2 maintains a high voltage. Therefore, the fifth transistor M5 maintains a turn off state. Further, when the fifth transistor M5 is turned on by supplying low voltage to the second node N2 when a low voltage of the sampling signal SR is not supplied to the next stage, the second output terminal 38 stably outputs high voltage by turning on of the fifth transistor M5.

Therefore, the stage 321 according to a second embodiment shown in FIG. 5, operates same as the stage according to the first embodiment, i.e., the waveform chart shown in FIG. 4 may show the method of operation thereof. Therefore, detailed description thereof will be omitted.

Figure 6:
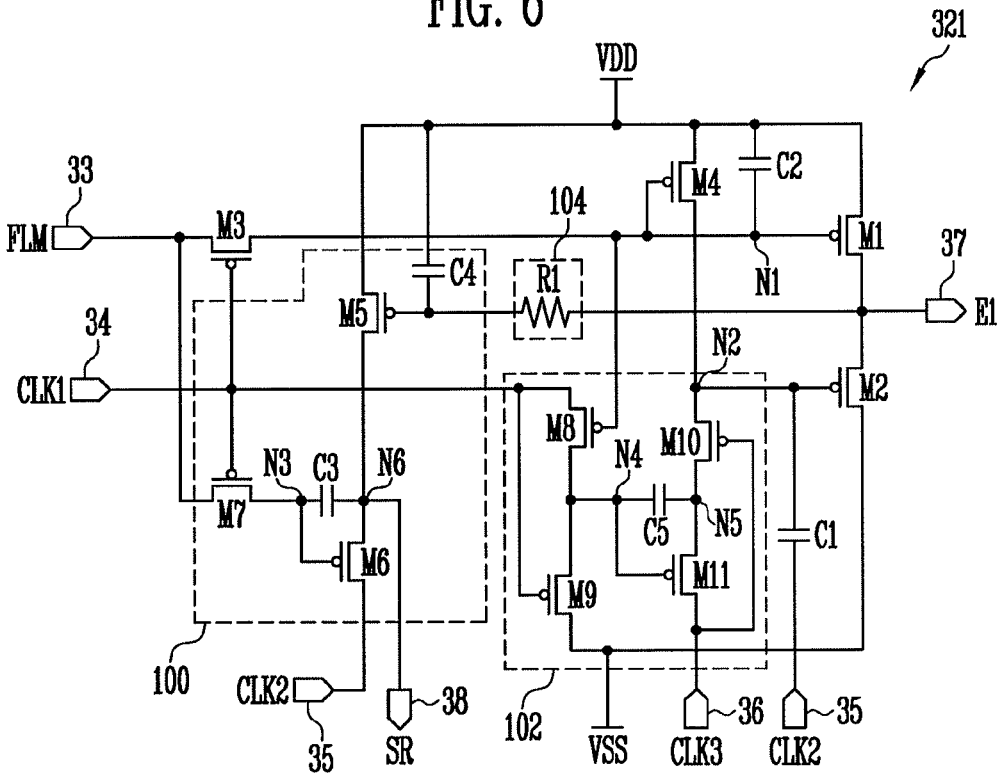
FIG. 6 is a circuit diagram showing a third embodiment of the stages shown in FIG. 2.

FIG. 6 is a circuit diagram showing a third example of the stage shown in FIG. 2.

Referring to FIG. 6, a gate electrode of the fifth transistor M5 is connected to the first output terminal 37 via a protection unit 104. That is, a gate electrode of the fifth transistor M5 is not directly connected to the emission control line E1 having a large load, and the protection unit 104 protecting the fifth transistor M5 from the static electricity, or the like, is included between a gate electrode of the fifth transistor M5 and the emission control line E1. The protection unit 104 includes, for example, a resistor R1. Meanwhile, the protection unit 104 may include a circuit device protecting the fifth transistor M5, the protection unit 104 is not necessarily configured with the resistor R1. For example, the protection unit 104 may be also configured using a capacitor, or the like.

In a period when the sampling signal having a low voltage is supplied to the second output terminal 38 in accordance with the second clock signal CLK2, a supply of the emission control signal having a high voltage to the emission control line E1 is maintained, accordingly, the fifth transistor M5 maintains a turn off state. When the fifth transistor M5 is turned on by stopping a supply of the emission control signal and maintaining a low voltage of the emission control line E1 when the sampling signal SR having a low voltage is not supplied to the next stage, the second output terminal 38 stably outputs high voltage by turning on of the fifth transistor M5.

Therefore, the method of operation of the stage 321 according to a third embodiment shown in FIG. 6 may be also explained by the waveform chart shown in FIG. 4, detailed description thereof will be omitted.

Figure 7:
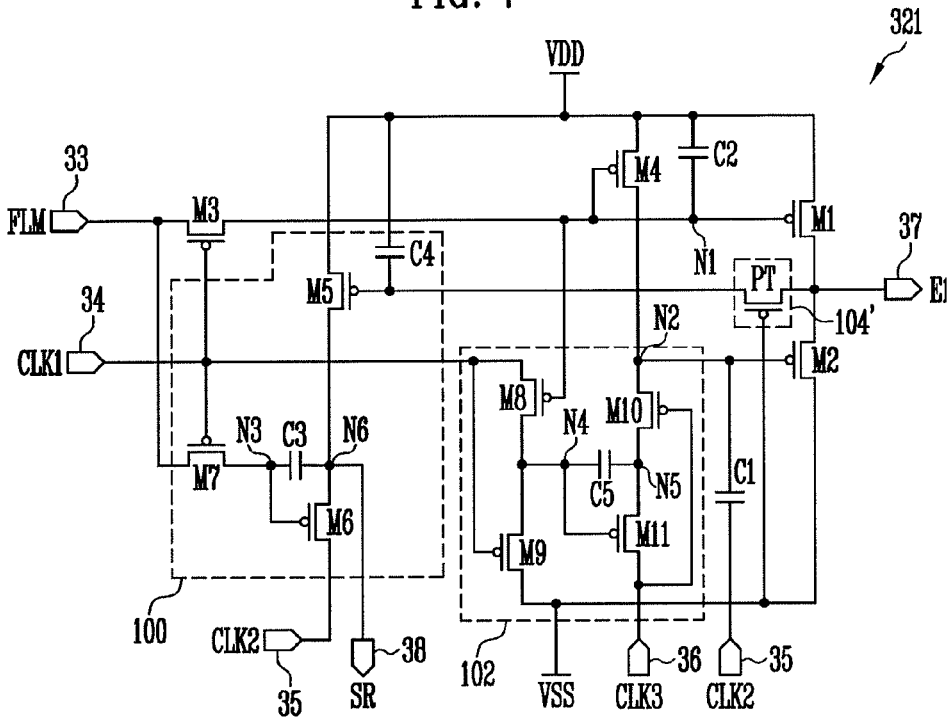
FIG. 7 is a circuit diagram showing a fourth embodiment of the stages shown in FIG. 2.

FIG. 7 is a circuit diagram showing a fourth example of the stage shown in FIG. 2. Referring to FIG. 7, a protection unit 104' includes a protection transistor PT connected between a gate electrode of the fifth transistor M5 and the first output terminal 37. A gate electrode of the protection transistor PT is connected to the second power source VSS. That is, the protection transistor PT maintains a turn on state by voltage of the second power source VSS. Therefore, the fifth transistor M5 is turned on or off by supplying voltage of the emission control line E1 to the gate electrode, and is protected from a static electricity, or the like, by the protection transistor PT.

Meanwhile, the method of operation of the stage 321 according to the fourth embodiment shown in FIG. 7 is same as the third embodiment shown in FIG. 6, and detailed description thereof will be omitted.

Figure 8:
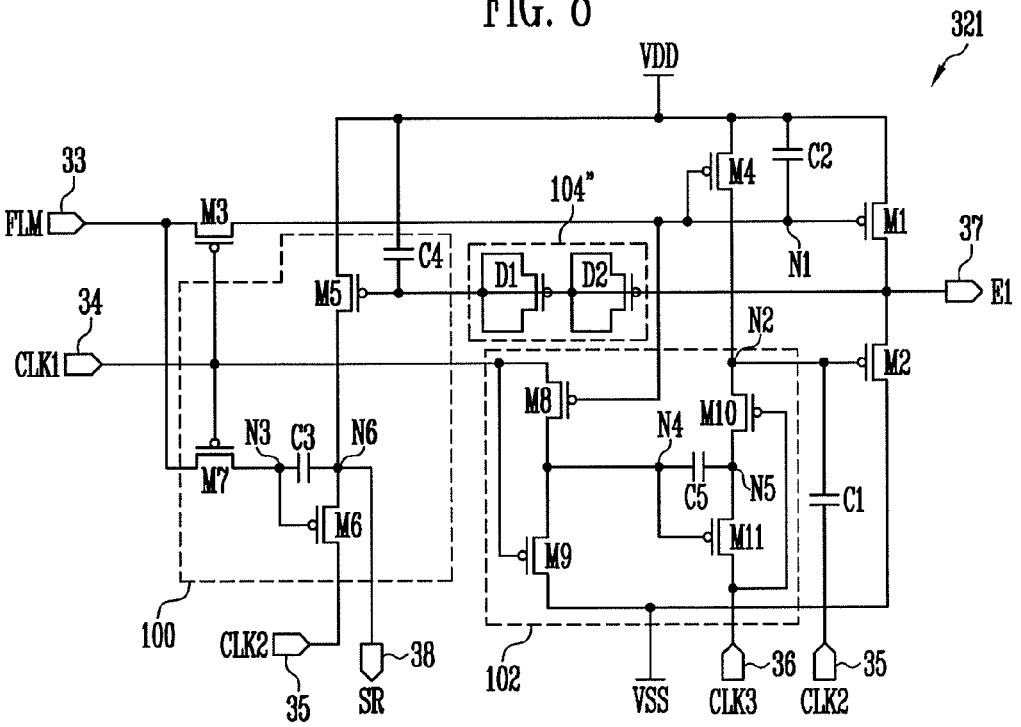
FIG. 8 is a circuit diagram showing a fifth embodiment of the stages shown in FIG. 2.

FIG. 8 is a circuit diagram showing a fifth example of the stage shown in FIG. 2. Referring to FIG. 8, a protection unit 104" includes at least one of transistors D diode-connected between a gate electrode of the fifth transistor M5 and the first output terminal 37. For example, the protection unit 104" includes two transistors D1 and D2 diode-connected between a gate electrode of the fifth transistor M5 and the first output terminal 37. Therefore, the fifth transistor M5 is turned on or off by supplying voltage of the emission control line E1 to the gate electrode, and is protected from a static electricity, or the like, by the transistors D1 and D2 diode-connected.

Meanwhile, the method of operation of the stage 321 according to the fifth embodiment shown in FIG. 8 is same as the third embodiment shown in FIG. 6, and detailed description thereof will be omitted.

Figure 9:
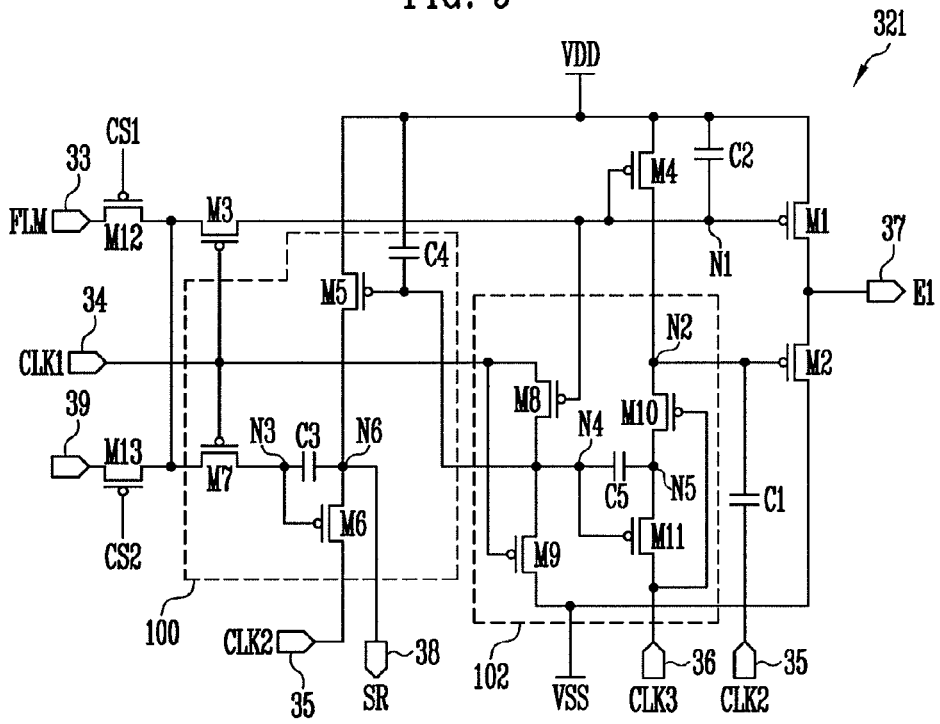
FIG. 9 is a circuit diagram showing a sixth embodiment of the stages shown in FIG. 2.

FIG. 9 is a circuit diagram showing a sixth example of the stage shown in FIG. 2. FIG. 9 is a configuration showing a stage further including a twelfth transistor M12 and a thirteenth transistor M13 in addition to the configuration of the first embodiment shown in FIG. 3. Accordingly, when FIG. 9 is explained, detailed description of a part which is similar to or same as FIG. 3 will be omitted. Referring to FIG. 9, the stage 321 according to the sixth embodiment includes the twelfth transistor M12 and the thirteenth transistor M13 for two-way driving.

The twelfth transistor M12 is connected between the first input terminal 33 and the third transistor M3. In addition, a gate electrode of the twelfth transistor M12 receives a first control signal CS1. The twelfth transistor M12 is turned on when the first control signal CS1 is supplied.

The thirteenth transistor M13 is connected between the fifth input terminal 39 and the seventh transistor M7 (or the first controller 100). In addition, a gate electrode of the thirteenth transistor M13 receives a second control signal CS2. The thirteenth transistor M13 as described above, is turned on when the second control signal CS2 is supplied. The fifth input terminal 39 is supplied a start signal or a sampling signal of the previous stage.

Here, the first control signal CS1 and the second control signal CS2 are supplied at a different time from each other. For example, when the emission control signal is supplied in a first direction (downwardly from a top of a panel), the first control signal CS1 is supplied so that the twelfth transistor M12 is turned on and the thirteenth transistor M13 maintains a turn off state. For example, when the emission control signal is supplied in a second direction (upwardly from a bottom of a panel), the second control signal CS2 is supplied so that the thirteenth transistor M13 is turned on and the twelfth transistor M12 maintains a turn off state.

The stage 321 according to the sixth embodiment of may further include the twelfth transistor M12 and thirteenth transistor M13 for two-way driving, however, the operation process thereof is same as the first embodiment shown in FIG. 3.

Meanwhile, a configuration according to the sixth embodiment, which further includes the twelfth transistor M12 and the thirteenth transistor M13, may be added to another of the configurations of any of the other embodiments. For example, the twelfth and thirteenth transistors M12 and M13 may be further included in the second to fifth embodiments shown in FIGS. 5 to 8.

Figure 10:
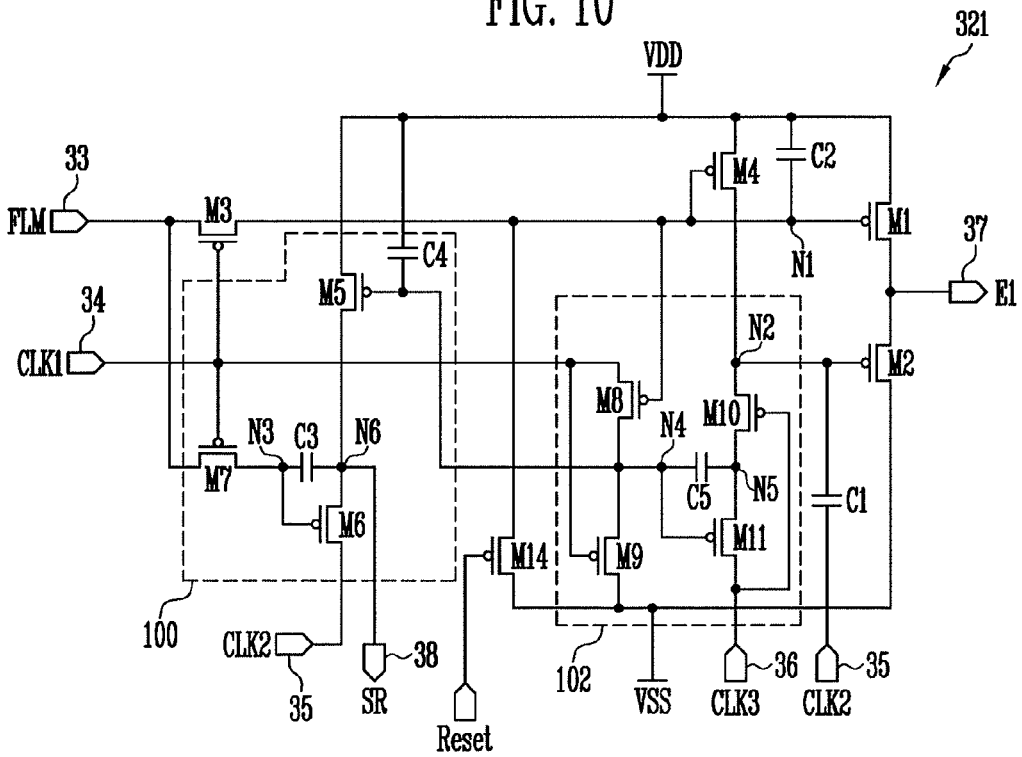
FIG. 10 is a circuit diagram showing a seventh embodiment of the stages shown in FIG. 2.

FIG. 10 is a circuit diagram showing a seventh embodiment of the stage shown in FIG. 2. FIG. 10 is a configuration showing a fourteenth transistor M14 further included in the stage according to the first embodiment shown in FIG. 3. Accordingly, when FIG. 10 is explained, detailed description of a part which is similar to or same as FIG. 3 will be omitted Referring to FIG. 10, the stage 321 according to the seventh embodiment, further includes a fourteenth transistor M14 connected between the first node N1 and the second power source VSS. When a reset signal (Reset) is supplied, the fourteenth transistor M14 is turned on so that the voltage of the second power source VSS is supplied to the first node N1. When the second power source VSS is supplied to the first node N1, the first transistor M1 is turned on, therefore, the voltage of the first power source VDD is supplied to the first output terminal 37.

The reset signal (Reset) is commonly supplied to all stages 321 to 32*n* when the power source is turned on and/or off. As described above, when the reset signal is supplied and the power supply is turned on and/or off, the emission control signals are supplied to the emission control lines E1 to En so that the pixels 50 are set in a non-emission state. That is, according to the seventh embodiment, it is possible to prevent over-current from flowing or unnecessary light from being generated when the power source is turned on and/or off using the reset signal.

Meanwhile, a configuration according to seventh embodiment, which further includes the fourteenth transistor M14, is not limited to be added to the first embodiment shown in FIG. 3. For example, the fourteenth transistors M14 may be further included in the second to sixth embodiments shown in FIGS. 5 to 9.

Additionally, in FIG. 2, the third clock signal CLK3 is supplied to all stages 321 to 32*n* by the same line, however, embodiments are not limited thereto. For example, each of the even and odd the stages may receive the third clock signal CLK3 via different lines, respectively. Then, the load of the third clock signal may be reduced, so that the stability of the driving may be improved.

By way of summation and review, the emission control line driver according to embodiments may prevent damage to an inner circuit device and secure output stability by allowing the gate electrodes of the transistors constituting an inner circuit to stably output the emission control signal without being directly connected to the output line. In particular, gate electrodes of transistors, e.g., all transistors, of the emission control line driver, may only be indirectly connected to an emission control line, rather than directly connected thereto.

In contrast, when the emission control line passes through a pixel region, it is relatively easy to accumulate charge. The accumulated charge may damage an inner circuit device of a stage, e.g., a gate insulating film of the transistor device, or the like. Therefore, it is difficult to secure reliable driving.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An emission control line driver, comprising:

a plurality of stages, wherein each of the stages comprises:

a first transistor connected between a first power source and a first output terminal, the first transistor being turned on or off in accordance with a voltage that is applied to a first node;

a second transistor connected between the first output terminal and a second power source, the second transistor being turned on or off in accordance with a voltage that is applied to a second node;

a third transistor connected between a first input terminal and the first node, the third transistor having a gate electrode connected to a second input terminal;

a fourth transistor connected between the first power source and the second node, the fourth transistor having a gate electrode connected to the first node;

a first controller connected to the first input terminal, the second input terminal, and a third input terminal, the first controller to supply a sampling signal to a second output terminal; and a second controller connected to the second input terminal and a fourth input terminal, the second controller to control the voltage of the second node, wherein the first controller includes a fifth transistor connected between the first power source and the second output terminal, the fifth transistor having a gate electrode connected to the second controller.

2. The emission control line driver according to claim 1, wherein the first controller further includes:

a sixth transistor connected between the second output terminal and the third input terminal, the sixth transistor having a gate electrode connected to a third node;

a seventh transistor connected between the first input terminal and the third node, the seventh transistor having a gate electrode connected to the second input terminal; and a capacitor connected between the third node and the second output terminal.

3. The emission control line driver according to claim 1, wherein the second controller includes:

an eighth transistor connected between the second input terminal and a fourth node, the eighth transistor having a gate electrode connected to the first node;

a ninth transistor connected between the fourth node and the second power source, the ninth transistor having a gate electrode connected to the second input terminal;

a tenth transistor connected between the second node and a fifth node, the tenth transistor having a gate electrode connected to the fourth input terminal;

an eleventh transistor connected between the fifth node and the fourth input terminal, the eleventh transistor having a gate electrode connected to the fourth node; and a capacitor connected between the fourth node and the fifth node.

4. The emission control line driver according to claim 3, wherein the fifth transistor has a gate electrode connected to the fourth node.

5. The emission control line driver according to claim 1, wherein the fifth transistor has a gate electrode connected to the second node.

6. The emission control line driver according to claim 1, further comprising a first capacitor connected between the third input terminal and the second node.

7. The emission control line driver according to claim 6, further comprising a second capacitor connected between the first power source and the first node.

8. The emission control line driver according to claim 7, further comprising another capacitor connected between a gate electrode of the fifth transistor and the first power source.

9. The emission control line driver according to claim 1, wherein the first input terminal receives a start signal or a sampling signal of a previous stage, the second input terminal receives a first clock signal, the third input terminal receives a second clock signal, and the fourth input terminal receives a third clock signal.

10. The emission control line driver according to claim 9, wherein the first clock signal, the second clock signal, and the third clock signal do not overlap each other.

11. The emission control line driver according to claim 9, wherein each of the first clock signal and the second clock signal are set in a period of i (i is a natural number) period, the third clock signal is set in a period of i/2 horizontal periods.

12. The emission control line driver according to claim 11, wherein the third clock signal is supplied after the first clock signal or the second clock signal is supplied in a horizontal period.

13. The emission control line driver according to claim 1, further comprising:

a twelfth transistor connected between the first input terminal and the third transistor, the twelfth transistor being turned on when a first control signal is supplied; and a thirteenth transistor connected between a fifth input terminal and the first controller, the thirteenth transistor being turned on when a second control signal is supplied.

14. The emission control line driver according to claim 13, wherein the first control signal and the second control signal do not overlap each other.

15. The emission control line driver according to claim 13, wherein the fifth input terminal receives a start signal or a sampling signal of a next stage.

16. The emission control line driver according to claim 1, further comprising, a fourteenth transistor connected between the first node and the second power source, the fourteenth transistor being turned on when a reset signal is supplied.

17. The emission control line driver according to claim 16, wherein the reset signal is commonly supplied to all of the stages.

18. An emission control line driver, comprising:

a plurality of stages, wherein each of the stages comprises:

a first transistor connected between a first power source and a first output terminal, the first transistor being turned on or off in accordance with a voltage that is applied to a first node;

a second transistor connected between the first output terminal and a second power source, the second transistor being turned on or off in accordance with a voltage that is applied to a second node;

a third transistor connected between a first input terminal and the first node, the third transistor having a gate electrode connected to a second input terminal;

a fourth transistor connected between the first power source and the second node, the fourth transistor having a gate electrode connected to the first node;

a first controller connected to the first input terminal, the second input terminal, and a third input terminal, the first controller to supply sampling signal to a second output terminal; and a second controller connected to the second input terminal and a fourth input terminal, the second controller to control the voltage of the second node, wherein the first controller includes a fifth transistor connected between the first power source and the second output terminal, the fifth transistor having a gate electrode connected to the first output terminal via a protection unit.

19. The emission control line driver according to claim 18, wherein the protection unit includes a resistor or a capacitor connected between a gate electrode of the fifth transistor and the first output terminal.

20. The emission control line driver according to claim 18, wherein the protection unit includes a protection transistor connected between a gate electrode of the fifth transistor and the first output terminal, the protection transistor having a gate electrode connected to the second power source.

21. The emission control line driver according to claim 18, wherein the protection unit includes at least one diode-connected transistor between a gate electrode of the fifth transistor and the first output terminal.

22. The emission control line driver according to claim 18, wherein the first controller further comprising:

a sixth transistor connected between the second output terminal and the third input terminal, the sixth transistor having a gate electrode connected to a third node;

a seventh transistor connected between the first input terminal and the third node, the seventh transistor having a gate electrode connected to the second input terminal; and a capacitor connected between the third node and the second output terminal.

23. The emission control line driver according to claim 18, wherein the second controller includes:

an eighth transistor connected between the second input terminal and a fourth node, the eighth transistor having a gate electrode connected to the first node;

a ninth transistor connected between the fourth node and the second power source, the ninth transistor having a gate electrode connected to the second input terminal;

a tenth transistor connected between the second node and a fifth node, the tenth transistor having a gate electrode connected to the fourth input terminal;

an eleventh transistor connected between the fifth node and the fourth input terminal, the eleventh transistor having a gate electrode connected to the fourth node; and a capacitor connected between the fourth node and the fifth node.

24. The emission control line driver according to claim 18, further comprising a first capacitor connected between the third input terminal and the second node.

25. The emission control line driver according to claim 24, further comprising a second capacitor connected between the first power source and the first node.

26. The emission control line driver according to claim 25, further comprising another capacitor connected between a gate electrode of the fifth transistor and the first power source.

27. The emission control line driver according to claim 18, wherein the first input terminal receives a start signal or a sampling signal of a previous stage, the second input terminal receives a first clock signal, the third input terminal receives a second clock signal, and the fourth input terminal receives a third clock signal.

28. The emission control line driver according to claim 27, wherein the first clock signal, the second clock signal, and the third clock signal do not overlap each other.

29. The emission control line driver according to claim 27, wherein each of the first clock signal and the second clock signal are set in a period of i (i is a natural number) period, and the third clock signal is set in a period of i/2 horizontal periods.

30. The emission control line driver according to claim 29, wherein the third clock signal is supplied after the first clock signal or the second clock signal is supplied in a horizontal period.

31. The emission control line driver according to claim 18, further comprising:

a twelfth transistor connected between the first input terminal and the third transistor, and turned on when a first control signal is supplied; and a thirteenth transistor connected between a fifth input terminal and the first controller, and turned on when a second control signal is supplied.

32. The emission control line driver according to claim 31, wherein the first control signal and the second control signal do not overlap each other.

33. The emission control line driver according to claim 31, wherein the fifth input terminal receives a start signal or a sampling signal of a next stage.

34. The emission control line driver according to claim 18, further comprising a fourteenth transistor connected between the first node and the second power source, and turned on when a reset signal is supplied.

35. The emission control line driver according to claim 34, wherein the reset signal is commonly supplied to all of the stages.

* * * * *